United States Patent [19]

Vincent

[11] 4,217,954

[45] Aug. 19, 1980

[54] COOLING PLATE FOR A FURNACE IN A METALLURGICAL PLANT

[75] Inventor: August Vincent, Oberhausen, Fed. Rep. of Germany

[73] Assignee: Gutehoffnungshütte Sterkrade Aktiengesellschaft, Oberhausen, Fed. Rep. of Germany

[21] Appl. No.: 7,605

[22] Filed: Jan. 29, 1979

[30] Foreign Application Priority Data

Feb. 3, 1978 [DE] Fed. Rep. of Germany ..... 2804544

[51] Int. Cl.[2] ..... F28F 19/06; F28F 7/02; C21B 7/10

[52] U.S. Cl. ..... 165/133; 165/134 R; 165/180; 165/DIG. 8; 266/193

[58] Field of Search ..... 165/133, 180, DIG. 8, 165/134; 266/193

[56] References Cited

U.S. PATENT DOCUMENTS

| | | | |
|---|---|---|---|
| 2,707,096 | 4/1955 | Koopmans | 165/180 |
| 3,706,343 | 12/1972 | Saiga et al. | 165/180 |
| 3,853,309 | 12/1974 | Widmer | 165/180 |
| 4,004,790 | 1/1977 | Krol et al. | 266/193 |
| 4,150,818 | 4/1979 | Bühler et al. | 266/193 |

FOREIGN PATENT DOCUMENTS

| | | | |
|---|---|---|---|
| 2128827 | 12/1971 | Fed. Rep. of Germany | 266/193 |
| 610484 | 10/1960 | Italy | 165/180 |
| 48-26564 | 8/1973 | Japan | 266/193 |

*Primary Examiner*—Sheldon Richter
*Attorney, Agent, or Firm*—Toren, McGeady and Stanger

[57] ABSTRACT

A cooling plate for a furnace for use in metallurgical plants made of cast iron with steel tubes therein for carrying a cooling agent, wherein the tubes have a jacket of one or more layers on the outside thereof, the first layer being a carbide-stabilizing metal and the other layers being thermally resistant metal oxides or mixtures of metal oxides and alloys of metals. The tubes are resistant to carburization and provide improved heat transmitting properties.

7 Claims, 3 Drawing Figures

COOLING PLATE FOR A FURNACE IN A METALLURGICAL PLANT

BACKGROUND OF THE INVENTION

1. Field of the Invention

The invention relates to a cooling plate for a furnace in a metallurgical plant. More particularly, it concerns a cooling plate for a blast furnace which cooling plate is made of cast iron and has steel tubes cast therein for receiving the cooling agent and a jacket of one or several layers which sheaths the tubes and is arranged between the tubes and the cast body of the cooling plate.

2. Description of the Prior Art

Cooling plates of this type are arranged in front of the casing or jacket of a furnace in a metallurgical plant, e.g., blast furnace, toward the interior of the furance and protect the casing or jacket against the heat which is discharged to the outside through the refractory furnace lining. For this purpose, vertically extending tubes are cast into the cast-iron cooling plates. These tubes conduct a cooling agent to remove the heat flow which is discharged from the furnace.

To maintain the resistance of the tubes to conduct the cooling agent, the tube material must be protected against the carburizing effect of the high temperature cast iron which surrounds the tube during the casting procedure. For this purpose, it is known to provide between the tubes and the cast body of the cooling plate, a jacket which sheaths the tubes. The jacket may be made of a ceramic material which consists of a mixture of silicon dioxide and dimethyl polysiloxane (German Offenlegungsschrift No. 21 28 827). It is also known to use basic substances, e.g., aluminum oxide, titanium oxide and zirconium oxide.

However, in actual use of such cooling plates whose cast-in steel tubes were provided with a ceramic sheathing, it has been found that this protection is not always sufficient. Due to the sudden heating during casting, cracks will occur in the coating because of the different thermal expansion coefficients of the steel tube and the ceramic layer. At these locations, these cracks will lead to a carburization of the steel tube and, thus, to a reduction of the ductility. This has a particularly disadvantageous effect in the curved tube portions which are under a high mechanical load.

Furthermore, in ceramic layers which are applied by painting or spraying, it is difficult to avoid the presence of very small hollow spaces and air cushions which adversely influence the heat transfer as a result of the formation of air gaps.

However, the removal of the amount of heat applied to the hot side of the cooling plate through the plate into the cooling tubes is the deciding factor with respect to the durability of the plate. When the heat is removed too slowly, the plate may wear prematurely and the steel tube may rupture due to its reduced ductility caused by carburization. The optimum heat removal cannot then be obtained because of the air gap produced by the ceramic sheathing of the tubes, the entrapped air being a poor conductor of heat.

SUMMARY OF THE INVENTION

It is the task of the invention to provide a cooling plate for a furnace in a metallurgical plant having good heat removal properties with respect to heat transfer from the cast iron body into the steel tubes. This is accomplished by means of an improved heat transfer coefficient and prevents carburization from the cast-round cast iron into the steel tubes, and, additionally, advantageously affects the ductility of the cast steel tubes.

In accordance with the invention, this task is solved by means of a cooling plate in which the jacket which sheaths the tubes consists of a first layer of a carbide-stabilizing metal which is directly applied to the outer surface of the tube and, a second layer of a thermally resistant metal oxide or a mixture of metal oxides and a metal alloy or another metal or metal alloy.

DESCRIPTION OF THE PREFERRED EMBODIMENT

Figure 1:
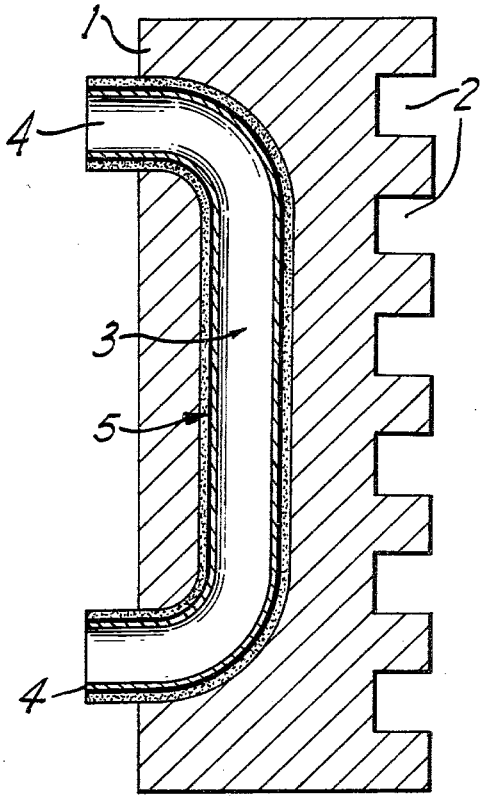
FIG. 1 shows a cross-section of the cooling plate with a cast-in steel tube.

Referring to the drawings and particularly, FIG. 1, the cooling plate consists of a cast iron body 1 which is generally provided with recesses 2 on the side facing toward the interior of the furnace. The recesses 2 serve to receive refractories. Cast into the cast iron body 1 are steel tubes 3 whose ends 4 extend out of the cast iron body on that side which is located opposite the recesses 2.

Figure 2:
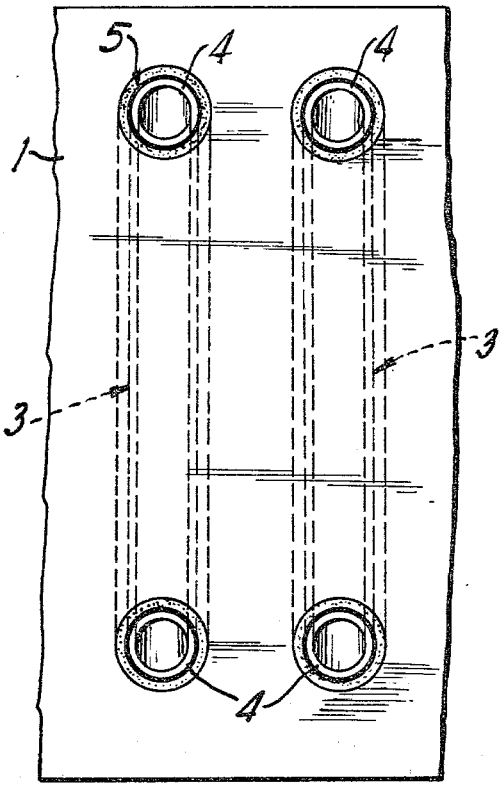
FIG. 2 shows a top view of the cooling plate on the side where the tubes are connected.
Figure 3:
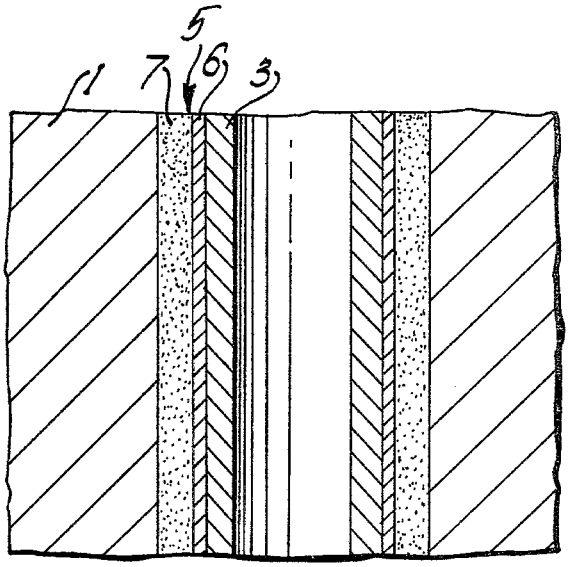
FIG. 3 shows an enlarged detail of FIG. 1.

As shown in FIG. 2, the steel tubes 3 are sheathed by a jacket 5 which consists of one or several layers 6 and 7 (FIG. 3) and separates the tube surface from the surrounding cast iron body 1. The first layer 6 which is directly applied to the outer surface of the tube consists of a carbide-stabilizing metal, particularly chromium, molybdenum, vanadium, zirconium, titanium or their alloys. Onto this first layer 6, there is applied the second layer 7 of thermally resistant metal oxide or mixtures of metal oxides and a metal alloy.

The carburization of the steel tube is prevented during the casting of the iron by directly applying a first layer to the outer surface of the tube of a carbide stabilizing metal, and particularly, Cr, Mo, V, W, Ti, Zr, Nb, Ta. These metals have a high affinity for carbon, i.e., their free enthalpy of formation reaches deep into the negative range relative to $Fe_3C$. As a result, at the surface of contact between casting and metal layer, a blocking-off of the carbon is achieved.

The same effect is achieved when the layer consists of an alloy of a single or of several of the metals. The metals can be applied by flame-spraying, plasma-spraying, electrolytic deposition or other known methods. The thickness of the layer is preferably 0.10 to 0.20 mm.

A metallic bond between the cast body and the steel tube is prevented, when the layer applied first consists of a carbide-stabilizing metal, for example, chromium, and a second layer consists of a thermally resistant metal oxide or oxide mixtures or a mixture of metal oxides and a metal alloy. The second layer preferably consists of aluminum oxide ($Al_2O_3$), titanium oxide ($TiO_2$), zirconium oxide ($ZrO_2$) or a mixture of $Al_2O_3$ and $TiO_2$ and a nickel alloy.

The metal oxides can be applied by flame-spraying, wet-spraying, plasma-spraying or other known methods.

Since the carburization of the tube is prevented by the chromium layer which is applied first, a thickness of 0.1 to 0.2 mm for the ceramic or mixed ceramic coat is sufficient. Compared to the conventional ceramic coatings, the possible air gap between tube and cast plate is reduced to a minimum and, thus, the heat transfer from the cast body to the steel tubes conducting the cooling agent is significantly improved.

A first chromium layer applied on the steel tubes does not only prevent their carburization, but, additionally, a decarburization of the outer regions of the steel tubes takes place, i.e., an additional ductile ferrite layer is formed. Such an additional ferritic layer in the outer wall regions of the tubes is advantageous since additional protection against ruptures is achieved due to the improved ductility of the tubes. This is particularly true, for example, in the outer arcs of the curved portions of the tubes which, in the case of conventional ceramic coatings, have a tendency toward increased carburization and are subject to an especially high mechanical load during operation of the cooling plate.

The sheathing of the steel tubes can also be designed in such a way that the first carbide-stabilizing metallic layer and an additional layer are applied only to the curved portions of the tubes, but that the straight tube portions are sheathed with a coating of stable metal oxides. The advantage of such a coating is that the carburization during casting which, according to experience, occurs more at the curved portions of the tube, is effectively prevented and that the straight tube portions can be provided with a uniform sheathing. This results in a good heat transfer and, at the same time, a cost reduction, since the lower limit of thickness of the layer is sufficient for these straight portions.

Another improvement in the heat removal from the hot side of the cooling plate is achieved when the metallic contact between the cast body and the tubes is not interrupted by the ceramic layer. When the tubes are sheathed with only one layer of chromium, during casting, a portion of the applied metal is absorbed by the cast iron. As a result, ledeburitic, i.e., brittle or non-ductile, zones are formed around the tube.

The diffusion of chromium into the cast iron is excluded, when the first layer directly applied to the outer surface of the tube consists of chromium and the second layer consists of iron. Instead of iron, the second layer can also be formed of other metals. It is advantageous to use nickel or a nickel alloy for the second layer which counteracts the formation of a ledeburitic structure in the cast iron and, additionally, has a carbon blocking effect.

What is claimed is:

1. In a cooling plate for a metallurgical plant furnace, said cooling plate being of cast iron with steel tubes for receiving and carrying a cooling agent through said plate, said tubes having a jacket of one or several layers sheathing the tubes and being located between the tubes and the cast body of the cooling plate, the improvement which comprises said tubes having a first layer directly applied to the outer surface of said tube of carbide-stabilizing metal selected from the group consisting of Cr, Mo, V, W, Ti, Zr, Nb, Ta and alloys of one or more of said metals, and a second layer deposited thereon of a thermally resistant metal oxide, a mixture of metal oxides and a metal alloy or another metal.

2. The cooling plate of claim 1 wherein the second layer is selected from the group consisting of $Al_2O_3$, $TiO_2$, $ZrO_2$ or a mixture of $Al_2O_3$, $TiO_2$ and nickel alloys.

3. The cooling plate of claim 1 wherein the first layer is chromium and said second layer is iron.

4. The cooling plate of claim 1 wherein the first layer is chromium and the second layer is nickel or a nickel alloy.

5. The cooling plate of claim 1 wherein the first and second layers are metallic and are applied by flame-spraying, plasma-spraying or electrolytic deposition.

6. The cooling plate of claim 1 wherein the second layer is an oxide layer and is applied by wet spraying, flame-spraying or plasma spraying.

7. The cooling plate of claim 1 wherein the first carbide-stabilizing metallic layer and the second layer are applied only to the curved portions of said tubes and the straight tube portions are sheathed with a coating of stable metal oxides.

* * * * *